US008764224B2

(12) United States Patent
Tong

(10) Patent No.: US 8,764,224 B2
(45) Date of Patent: Jul. 1, 2014

(54) LUMINAIRE WITH DISTRIBUTED LED SOURCES

(75) Inventor: Tao Tong, Ventura, CA (US)

(73) Assignee: Cree, Inc., Durham, NC (US)

( * ) Notice: Subject to any disclaimer, the term of this patent is extended or adjusted under 35 U.S.C. 154(b) by 517 days.

(21) Appl. No.: 12/855,500

(22) Filed: Aug. 12, 2010

(65) Prior Publication Data

US 2012/0039073 A1 Feb. 16, 2012

(51) Int. Cl.
*F21V 21/00* (2006.01)

(52) U.S. Cl.
USPC ..... 362/231; 362/235; 362/800

(58) Field of Classification Search
USPC ..... 362/253, 294, 362, 800, 555, 373, 297, 362/240, 227, 249, 250
See application file for complete search history.

(56) References Cited

U.S. PATENT DOCUMENTS

| | | | | |
|---|---|---|---|---|
| 1,393,573 | A | 10/1921 | Ritter | 362/509 |
| 1,880,399 | A | 10/1932 | Benjamin | 362/277 |
| 2,214,600 | A | 9/1940 | Winkler | 362/279 |
| 2,981,827 | A | 4/1961 | Orsatta | 362/84 |
| 3,395,272 | A | 7/1968 | Nicholl | 362/305 |
| 4,420,800 | A | 12/1983 | Van Horn | 362/297 |
| 4,946,547 | A | 8/1990 | Palmour et al. | 156/643 |
| 5,200,022 | A | 4/1993 | Kong et al. | 156/612 |
| RE34,861 | E | 2/1995 | Davis et al. | 437/100 |
| 5,912,915 | A | 6/1999 | Reed et al. | 372/93 |
| 6,076,948 | A * | 6/2000 | Bukosky et al. | 362/494 |
| 6,149,283 | A | 11/2000 | Conway et al. | |
| 6,409,361 | B1 * | 6/2002 | Ikeda | 362/240 |
| 6,454,439 | B1 | 9/2002 | Camarota | 362/293 |
| 6,558,032 | B2 | 5/2003 | Kondo et al. | 362/516 |
| 6,585,397 | B1 | 7/2003 | Ebiko | |
| 6,657,236 | B1 | 12/2003 | Thibeault et al. | 257/98 |
| 6,720,583 | B2 | 4/2004 | Nunoue et al. | 257/98 |
| 6,758,582 | B1 | 7/2004 | Hsiao et al. | 362/302 |
| 6,793,373 | B2 | 9/2004 | Matsuba et al. | 362/260 |
| 6,812,502 | B1 | 11/2004 | Chien et al. | 257/99 |
| 6,817,737 | B2 | 11/2004 | Romano et al. | 362/293 |
| 6,840,652 | B1 * | 1/2005 | Hymer | 362/235 |

(Continued)

FOREIGN PATENT DOCUMENTS

| | | |
|---|---|---|
| CN | 1841183 A | 10/2006 |
| CN | 201007449 | 1/2008 |

(Continued)

OTHER PUBLICATIONS

International Search Report and Written Opinion for counterpart PCT Application No. PCT/US2011/001394 mailed Nov. 3, 2011.

(Continued)

*Primary Examiner* — Joseph L Williams
(74) *Attorney, Agent, or Firm* — Koppel, Patrick, Heybl & Philpott

(57) ABSTRACT

A wide beam angle (diffuse) luminaire with an efficient multi-source radiative emitter array. Embodiments of the luminaire utilize one or more LEDs disposed around a perimeter of a protective casing. The LEDs are angled to emit into an internal cavity defined by the inner surface of the casing. The placement of the LEDs around the perimeter of the device reduces self-blocking and facilitates heat transfer from the LEDs through the casing or another heat sink and into the ambient. Light impinges on the inner surface and is redirected as useful emission. A diffuse reflective coating may be deposited on the inner surface to mix the light before it is emitted.

59 Claims, 5 Drawing Sheets

(56) References Cited

U.S. PATENT DOCUMENTS

| | | | | |
|---|---|---|---|---|
| 6,986,594 | B2 | 1/2006 | Wirth et al. | |
| 7,055,991 | B2 | 6/2006 | Lin | 362/311.02 |
| 7,213,940 | B1 | 5/2007 | Van de Ven et al. | 362/231 |
| 7,275,841 | B2 | 10/2007 | Kelly | 362/345 |
| 7,573,074 | B2 | 8/2009 | Shum et al. | 257/99 |
| 7,622,746 | B1 | 11/2009 | Lester et al. | 257/98 |
| 7,722,220 | B2 * | 5/2010 | Van De Ven | 362/294 |
| 7,784,977 | B2 | 8/2010 | Moolman et al. | 362/298 |
| 7,795,623 | B2 | 9/2010 | Emerson et al. | 257/79 |
| 7,821,023 | B2 | 10/2010 | Yuan et al. | 257/98 |
| 7,915,629 | B2 | 3/2011 | Ibbetson et al. | 257/98 |
| 7,922,366 | B2 | 4/2011 | Li | 362/304 |
| 8,431,423 | B2 | 4/2013 | Basin et al. | 438/26 |
| 2003/0025212 | A1 | 2/2003 | Bhat et al. | |
| 2003/0128733 | A1 | 7/2003 | Tan et al. | 372/96 |
| 2004/0155565 | A1 * | 8/2004 | Holder et al. | 313/113 |
| 2004/0217362 | A1 | 11/2004 | Slater et al. | |
| 2005/0168994 | A1 | 8/2005 | Jacobson et al. | 362/311 |
| 2005/0211993 | A1 | 9/2005 | Sano et al. | 257/79 |
| 2005/0242358 | A1 | 11/2005 | Chung-Cheng et al. | |
| 2006/0060874 | A1 | 3/2006 | Edmond et al. | 257/98 |
| 2006/0076568 | A1 | 4/2006 | Keller et al. | 257/98 |
| 2006/0157723 | A1 | 7/2006 | Lampkin et al. | 257/98 |
| 2006/0163586 | A1 | 7/2006 | Denbaars et al. | |
| 2006/0278885 | A1 | 12/2006 | Tain et al. | |
| 2007/0139923 | A1 | 6/2007 | Negley | |
| 2007/0145380 | A1 | 6/2007 | Shum et al. | |
| 2007/0158668 | A1 | 7/2007 | Tarsa et al. | 257/79 |
| 2007/0217193 | A1 | 9/2007 | Lin | |
| 2008/0061304 | A1 | 3/2008 | Huang et al. | |
| 2008/0123341 | A1 | 5/2008 | Chiu et al. | |
| 2008/0173884 | A1 | 7/2008 | Chitnis et al. | 438/22 |
| 2008/0179611 | A1 | 7/2008 | Chitnis et al. | 257/98 |
| 2008/0185609 | A1 | 8/2008 | Kozawa et al. | 257/99 |
| 2008/0191233 | A1 | 8/2008 | Yang et al. | |
| 2008/0265268 | A1 | 10/2008 | Braune et al. | 257/98 |
| 2008/0310158 | A1 | 12/2008 | Harbers et al. | 362/294 |
| 2009/0026478 | A1 | 1/2009 | Yoon et al. | 257/98 |
| 2009/0050908 | A1 | 2/2009 | Yuan et al. | 257/88 |
| 2009/0121241 | A1 | 5/2009 | Keller et al. | 257/94 |
| 2009/0152583 | A1 | 6/2009 | Chen et al. | 257/98 |
| 2009/0231856 | A1 | 9/2009 | Householder | |
| 2009/0283779 | A1 | 11/2009 | Negley et al. | 257/88 |
| 2009/0283787 | A1 | 11/2009 | Donofrio et al. | 257/98 |
| 2010/0001299 | A1 | 1/2010 | Chang et al. | 257/89 |
| 2010/0012962 | A1 | 1/2010 | Hong et al. | |
| 2010/0038659 | A1 | 2/2010 | Chen et al. | |
| 2010/0039822 | A1 | 2/2010 | Bailey | 362/296 |
| 2010/0051995 | A1 | 3/2010 | Katsuno et al. | |
| 2010/0059785 | A1 | 3/2010 | Lin et al. | |
| 2010/0065881 | A1 | 3/2010 | Kim | |
| 2010/0103678 | A1 | 4/2010 | Van de Ven et al. | 362/294 |
| 2010/0117099 | A1 | 5/2010 | Leung | 257/88 |
| 2010/0140635 | A1 | 6/2010 | Ibbetson et al. | |
| 2010/0140636 | A1 | 6/2010 | Donofrio et al. | 257/98 |
| 2010/0155746 | A1 | 6/2010 | Ibbetson et al. | 257/88 |
| 2010/0165633 | A1 | 7/2010 | Moolman et al. | 362/398 |
| 2010/0171094 | A1 | 7/2010 | Lu et al. | 257/13 |
| 2011/0049546 | A1 | 3/2011 | Heikman et al. | 257/98 |
| 2011/0075423 | A1 | 3/2011 | Van De Ven | |

FOREIGN PATENT DOCUMENTS

| | | | |
|---|---|---|---|
| CN | 101449100 | | 6/2009 |
| CN | 101460779 | | 6/2009 |
| DE | 102004040277 | | 2/2006 |
| DE | 102007003282 | | 7/2008 |
| DE | 102008035900 | | 11/2009 |
| EP | 1750310 | A2 | 2/2007 |
| EP | 2259345 | A1 | 12/2010 |
| EP | 2369650 | A2 | 9/2011 |
| JP | 06045649 | | 2/1994 |
| JP | 2005197289 | | 7/2005 |
| WO | WO 00/34709 | A1 | 6/2000 |
| WO | WO 2005/066539 | A1 | 7/2005 |
| WO | WO 2005/078338 | A1 | 8/2005 |
| WO | WO2005117152 | | 12/2005 |
| WO | WO 2006/092697 | A1 | 9/2006 |
| WO | WO 2007/130536 | A2 | 11/2007 |
| WO | WO2008149250 | | 12/2008 |
| WO | WO 2009/056927 | A1 | 5/2009 |
| WO | WO 2010/029475 | A1 | 3/2010 |
| WO | WO2010029475 | | 3/2010 |
| WO | WO2011031098 | A2 | 3/2011 |
| WO | WO2011071100 | A1 | 6/2011 |

OTHER PUBLICATIONS

C.H. Lin et al., "Enhancement of InGaN-GaN Indium-Tin-Oxide Flip-Chip Light-Emitting Diodes with TiO2-SiO2 Multilayer Stack Omnidirectional Reflector," IEEE Photonics Technology Letters, vol. 18, No. 19, Oct. 1, 2006, pp. 2050-2052.

Windisch et al. "Impact of Texture-Enhanced Transmission on High-Efficiency Surface-Textured Light-Emitting Diodes," Applied Physics Letters, vol. 79, No. 15, Oct. 2001, pp. 2315-2317.

Schnitzer et al. "30% External Quantum Efficiency From Surface Textured, Thin-Film Light-Emitting Diodes," Applied Physics Letters, Oct. 18, 1993, vol. 64, No. 16, pp. 2174-2176.

Windisch et al. "Light-Extraction Mechanisms in High-Efficiency Surface-Textured Light-Emitting Diodes," IEEE Journal on Selected Topics in Quantum Electronics, vol. 8, No. 2, Mar./Apr. 2002, pp. 248-255.

Streubel, et al. "High Brightness AlGaInP Light-Emitting Diodes," IEEE Journal on Selected Topics In Quantum Electronics, vol. 8, No. 2, Mar./Apr. 2002, pp. 321-332.

Cree EZ400 LED Data Sheet, 2007 Cree's EZBright LEDs.

Cree EZ700 LED Data Sheet, 2007 Cree's EZBright LEDs.

Cree EZ1000 LED Data Sheet, 2007 Cree's EZBright LEDs.

Cree EZBright290 LED Data Sheet, 2007 Cree's EZBright LEDs.

DOM LED Downlighting, Lithonia Lighting: an Acuity Brands, Company, www.lithonia.com, © 2009.

Ecos, Lighting the Next Generation, gothan: a division of Acuity Brands Lighting Inc., © 2008.

Renaissance Lighting brochure, © 2010.

International Search Report and Written Opinion for PCT Application No. PCT/US2010/002827 mailed May 2, 2011.

International Preliminary Report on Patentability from Application No. PCT/US09/66938, dated Apr. 3, 2012.

"High-Performance GaN-Based Vertical-Injection Light-Emitting Diodes With TiO2-SiO2 Omnidirectional Reflector and n-GaN Roughness" by H. W. Huang, et al., IEEE Photonics Technology Letters, vol. 19, No. 8, Apr. 15, 2007, pp. 565-567.

Office Action from U.S. Appl. No. 12/418,796, Dated: Jul. 20, 2011.

Office Action from U.S. Appl. No. 12/329,722, Dated: Oct. 27, 2010.

International Search Report and Written Opinion for Application No. PCT/US2012/034564, dated Sep. 5, 2012.

Office Action from U.S. Appl. No. 13/071,349, dated May 28, 2013.

Response to OA from U.S. Appl. No. 13/071,349, filed Jul. 18, 2013.

Office Action from U.S. Appl. No. 13/071,349, dated Jan. 17, 2013.

Response to OA from U.S. Appl. No. 13/071,349, filed Apr. 10, 2013.

Office Action from U.S. Appl. No. 12/553,025, dated Jun. 19, 2013.

Huang et al. High-Performance GaN-Based Vertical-Injection Light-Emitting Diodes with TiO2-Sio2 Ohnidirectional Reflector and n-GaN Roughness. IEEE Photonics Technology Letters, vol. 19, No. 8, Apr. 15, 2007, pp. 565-567.

Raoufi et al. Surface characterization and microstructure of ITO thin films at different annealing temperatures. Applied Surface Science 253 (2007), pp. 9085-9090.

Office Action from U.S. Appl. No. 13/168,689, dated Jun. 28, 2013.

Office Action from U.S. Appl. No. 12/606,377, dated Jul. 9, 2013.

Office Action from U.S. Appl. No. 12/418,796, dated Aug. 7, 2012.

Response to OA from U.S. Appl. No. 12/418,796, filed Nov. 7, 2012.

Office Action from U.S. Appl. No. 12/418,796, dated Feb. 22, 2012.

Response to OA from U.S. Appl. No. 12/418,796, filed Jun. 22, 2012.

Office Action from U.S. Appl. No. 13/415,626, dated Sep. 28, 2012.

Response to OA from U.S. Appl. No. 13/415,626, filed Jan. 23, 2013.

Office Action from U.S. Appl. No. 12/606,377, dated Nov. 26, 2012.

Response to OA from U.S. Appl. No. 12/606,377, filed Feb. 22, 2013.

(56) References Cited

OTHER PUBLICATIONS

Office Action from U.S. Appl. No. 12/757,179, dated Dec. 31, 2012.
Response to OA from U.S. Appl. No. 12/757,179, filed Apr. 23, 2013.
Office Action from U.S. Appl. No. 13/415,626, dated Feb. 28, 2013.
Response to OA from U.S. Appl. No. 13/415,626, filed Apr. 17, 2013.
Notice of Reasons for Rejection from Japanese Patent Appl. No. 2011-539526, dated Jun. 25, 2013.
First Office Action and Search Report from Chinese Patent Appl. No. 201080023107.8, dated Jul. 12, 2013.
International Search Report and Written Opinion from PCT Application No. PCT/US2013/028684, dated May 28, 2013.
Jong Kyu kim, et al., "GaInN Light-emitting Diodes with RuO2/SiO2/Ag Omni-directional Reflector", Applied Physics Letters, AIP, American Institute of Physics, Nelville, NY, US, vol. 84, No. 22, May 31, 2004, pp. 4508-4510, XP012061652.
Y.S. Zhao, et al., "Efficiency Enhancement of InGaN/GaN Light-Emitting Diodes with a Back-Surface distributed Bragg Reflector", Journal of Electronic Materials, vol. 32, No. 12, Dec. 1, 2003, pp. 1523-1526, XP055063308.
Xu Qing-tao, et al., "Enhancing Extraction Efficiency from GaN-based LED by Using an Omni-directional Reflector and Photonic Crystal", Optoelectronics Letters, vol. 5, No. 6, Nov. 1, 2009, pp. 405-408, XP055063309.
J.-Q Xi, et al., "Optical Thin-film Materials with Low Refractive Index for Broadband Elimination of Fresnel Reflection", Nature Photonics, Nature Publishing Group, UK, vol. 1, No. 3, Mar. 1, 2007, pp. 176-179, XP002590687.
First Office Action from Chinese Patent Appl. No. 201180047069.4, dated Dec. 18, 2013.
First Office Action from Japanese Patent Appl. No. 201180047069.4, dated: Dec. 18, 2013.
Search Report from Japanese Patent Appl. No. 201180047069.4, dated: Dec. 10, 2013.
Final Office Action from U.S. Appl. No. 12/553,025, dated Dec. 31, 2013.
Lin, et al., "Enhancement of InGaN-GaN Indium-Tiin-Oxide Flip-Chip Light-Emitting Diodes with TiO2-SiO2 Multilayer Stack Omnidirectional Reflector", IEEE Photonics Technology Letters, vol. 18, No. 19, Oct. 1, 2006.
Second OA from Chinese Patent Appl. No. 201080023107.8, dated Mar. 7, 2014.
Office Action from U.S. Appl. No. 12/757,179, dated Mar. 11, 2014.
Office Action from U.S. Appl. No. 13/909,927, dated Apr. 2, 2014.
Office Action from U.S. Appl. No. 12/606,377, dated Apr. 9, 2014.

* cited by examiner

FIG. 1a
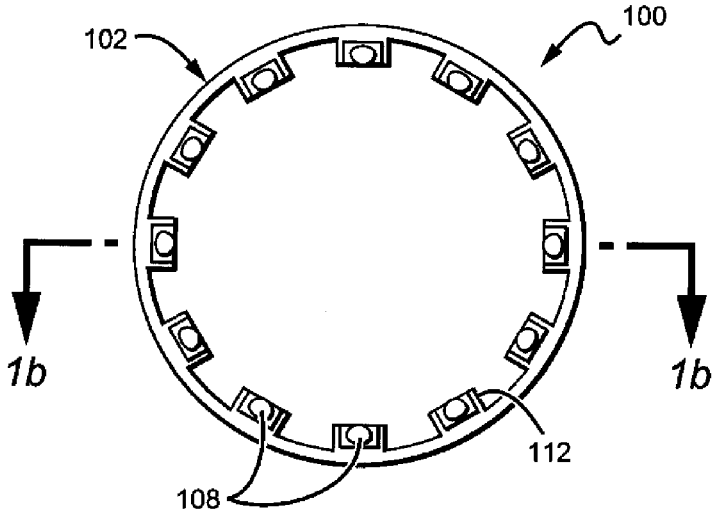
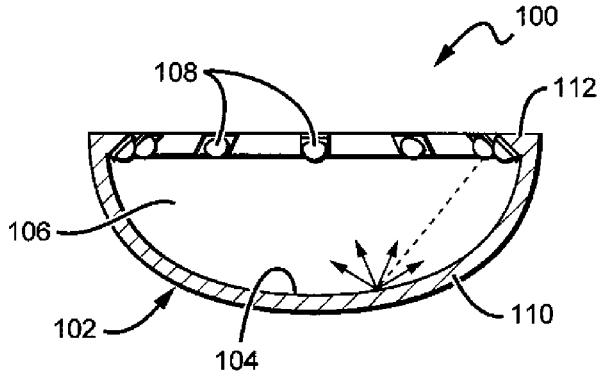
FIG. 1b
FIG. 2a
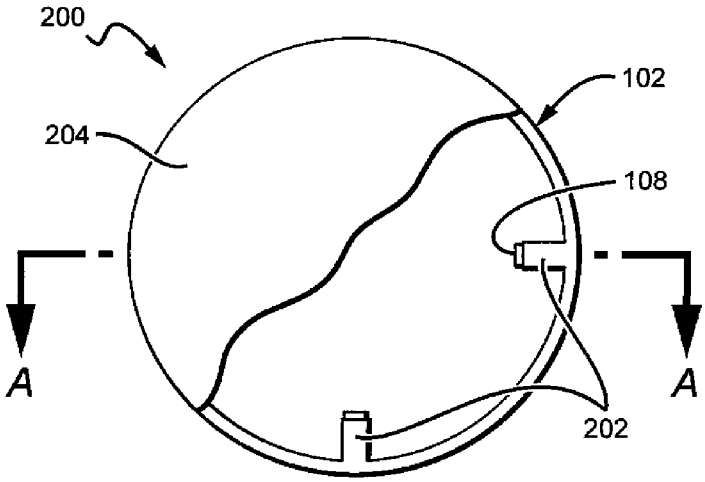

LUMINAIRE WITH DISTRIBUTED LED SOURCES

BACKGROUND OF THE INVENTION

1. Field of the Invention

The present invention relates to luminaire devices for lighting applications and, more particularly, to luminaires having distributed LED sources.

2. Description of the Related Art

Light emitting diodes (LEDs) are solid state devices that convert electric energy to light and generally comprise one or more active regions of semiconductor material interposed between oppositely doped semiconductor layers. When a bias is applied across the doped layers, holes and electrons are injected into the active region where they recombine to generate light. Light is produced in the active region and emitted from surfaces of the LED.

LEDs have certain characteristics that make them desirable for many lighting applications that were previously the realm of incandescent or fluorescent lights. Incandescent lights are very energy-inefficient light sources with approximately ninety percent of the electricity they consume being released as heat rather than light. Fluorescent light bulbs are more energy efficient than incandescent light bulbs by a factor of about 10, but are still relatively inefficient. LEDs by contrast, can emit the same luminous flux as incandescent and fluorescent lights using a fraction of the energy.

In addition, LEDs can have a significantly longer operational lifetime. Incandescent light bulbs have relatively short lifetimes, with some having a lifetime in the range of about 750-1000 hours. Fluorescent bulbs can also have lifetimes longer than incandescent bulbs such as in the range of approximately 10,000-20,000 hours, but provide less desirable color reproduction. In comparison, LEDs can have lifetimes between 50,000 and 70,000 hours. The increased efficiency and extended lifetime of LEDs is attractive to many lighting suppliers and has resulted in their LED lights being used in place of conventional lighting in many different applications. It is predicted that further improvements will result in their general acceptance in more and more lighting applications. An increase in the adoption of LEDs in place of incandescent or fluorescent lighting would result in increased lighting efficiency and significant energy saving.

Other LED components or lamps have been developed that comprise an array of multiple LED packages mounted to a (PCB), substrate or submount. The array of LED packages can comprise groups of LED packages emitting different colors, and specular reflector systems to reflect light emitted by the LED chips. Some of these LED components are arranged to produce a white light combination of the light emitted by the different LED chips.

In order to generate a desired output color, it is sometimes necessary to mix colors of light which are more easily produced using common semiconductor systems. Of particular interest is the generation of white light for use in everyday lighting applications. Conventional LEDs cannot generate white light from their active layers; it must be produced from a combination of other colors. For example, blue emitting LEDs have been used to generate white light by surrounding the blue LED with a yellow phosphor, polymer or dye, with a typical phosphor being cerium-doped yttrium aluminum garnet (Ce:YAG). The surrounding phosphor material "down-converts" some of the blue light, changing it to yellow light. Some of the blue light passes through the phosphor without being changed while a substantial portion of the light is down-converted to yellow. The LED emits both blue and yellow light, which combine to yield white light.

In another known approach, light from a violet or ultraviolet emitting LED has been converted to white light by surrounding the LED with multicolor phosphors or dyes. Indeed, many other color combinations have been used to generate white light.

Because of the physical arrangement of the various source elements, multicolor sources often cast shadows with color separation and provide an output with poor color uniformity. For example, a source featuring blue and yellow sources may appear to have a blue tint when viewed head on and a yellow tint when viewed from the side. Thus, one challenge associated with multicolor light sources is good spatial color mixing over the entire range of viewing angles. One known approach to the problem of color mixing is to use a diffuser to scatter light from the various sources.

Another known method to improve color mixing is to reflect or bounce the light off of several surfaces before it is emitted from the lamp. This has the effect of disassociating the emitted light from its initial emission angle. Uniformity typically improves with an increasing number of bounces, but each bounce has an associated optical loss. Some applications use intermediate diffusion mechanisms (e.g., formed diffusers and textured lenses) to mix the various colors of light. Many of these devices are lossy and, thus, improve the color uniformity at the expense of the optical efficiency of the device.

Typical direct view lamps, which are known in the art, emit both uncontrolled and controlled light. Uncontrolled light is light that is directly emitted from the lamp without any reflective bounces to guide it. According to probability, a portion of the uncontrolled light is emitted in a direction that is useful for a given application. Controlled light is directed in a certain direction with reflective or refractive surfaces. The mixture of uncontrolled and controlled light define the output beam profile.

Also known in the art, a retroreflective lamp arrangement, such as a vehicle headlamp, utilizes multiple reflective surfaces to control all of the emitted light. That is, light from the source either bounces off an outer reflector (single bounce) or it bounces off a retroreflector and then off of an outer reflector (double bounce). Either way the light is redirected before emission and, thus, controlled. In a typical headlamp application, the source is an omni-emitter, suspended at the focal point of an outer reflector. A retroreflector is used to reflect the light from the front hemisphere of the source back through the envelope of the source, changing the source to a single hemisphere emitter.

Many current luminaire designs utilize forward-facing LED components with a specular reflector disposed behind the LEDs. One design challenge associated with multi-source luminaires is blending the light from LED sources within the luminaire so that the individual sources are not visible to an observer. Heavily diffusive elements are also used to mix the color spectra from the various sources to achieve a uniform output color profile. To blend the sources and aid in color mixing, heavily diffusive exit windows have been used. However, transmission through such heavily diffusive materials causes significant optical loss.

Many modern lighting applications demand high power LEDs for increased brightness. High power LEDs can draw large currents, generating significant amounts of heat that must be managed. Many systems utilize heat sinks which must be in good thermal contact with the heat-generating light sources. Some applications rely on cooling techniques such as heat pipes which can be complicated and expensive.

SUMMARY OF THE INVENTION

A luminaire device according to an embodiment of the present invention comprises the following elements. A casing has an exit end and an inner surface, with the casing defining a cavity. At least one radiative source is mounted around a perimeter of the casing. The radiative source(s) is/are angled to emit radiation toward the inner surface.

A luminaire device according to an embodiment of the present invention comprises the following elements. A casing has an exit end and an inner surface with the casing defining a cavity. A plurality of light emitters is disposed around a perimeter of the casing at the exit end. Each of the light emitters is angled to emit light toward the inner surface.

BRIEF DESCRIPTION OF THE DRAWINGS

FIG. 1*a* is a bottom view of a luminaire according to an embodiment of the present invention with a portion of the casing not shown to expose the LEDs.

FIG. 1*b* is an internal view of one half of the luminaire of FIG. 1*a* from cut plane A-A.

FIG. 2*a* is a top plan view of a luminaire according to an embodiment of the present invention with half of a faceplate not pictured to reveal the elements underneath.

DETAILED DESCRIPTION OF THE INVENTION

Figure 2B:
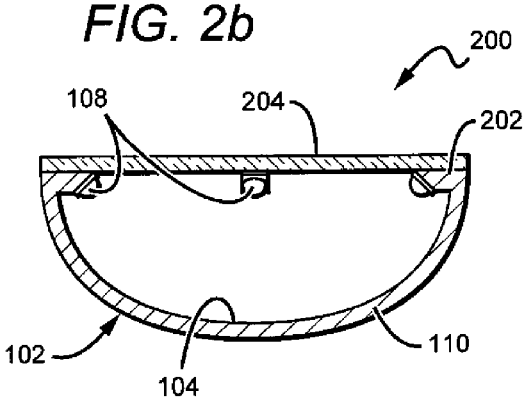
FIG. 2*b* is an internal view of one half of the luminaire of FIG. 2*a* from cut plane B-B.

Embodiments of the present invention provide a wide beam angle (diffuse) luminaire designed to accommodate an efficient multi-source radiative emitter array. One such radiative source is a light emitting diode (LED) which will be referred to throughout the specification, although it is understood that emitters emitting outside the visible spectrum (e.g., ultraviolet or infrared emitters) and other types of radiative sources might also be used. Embodiments of the luminaire utilize one or more LEDs disposed around a perimeter of a protective casing. The LEDs are angled to emit into an internal cavity defined by the inner surface of the casing. The placement of the LEDs around the perimeter of the device reduces blocking associated with center-mount luminaire models and facilitates heat transfer from the LEDs through the casing or another heat sink and into the ambient. Light impinges on the inner surface and is redirected as useful emission from the lamp. A reflective coating may be deposited on the inner surface to mix the light before it is emitted.

Embodiments of the present invention are described herein with reference to conversion materials, wavelength conversion materials, remote phosphors, phosphors, phosphor layers and related terms. The use of these terms should not be construed as limiting. It is understood that the use of the term remote phosphors, phosphor or phosphor layers is meant to encompass and be equally applicable to all wavelength conversion materials.

It is understood that when an element is referred to as being "on" another element, it can be directly on the other element or intervening elements may also be present. Furthermore, relative terms such as "inner", "outer", "upper", "above", "lower", "beneath", and "below", and similar terms, may be used herein to describe a relationship of one element to another. It is understood that these terms are intended to encompass different orientations of the device in addition to the orientation depicted in the figures.

Although the ordinal terms first, second, etc., may be used herein to describe various elements, components, regions and/or sections, these elements, components, regions, and/or sections should not be limited by these terms. These terms are only used to distinguish one element, component, region, or section from another. Thus, unless expressly stated otherwise, a first element, component, region, or section discussed below could be termed a second element, component, region, or section without departing from the teachings of the present invention.

As used herein, the term "source" can be used to indicate a single light emitter or more than one light emitter functioning as a single source. For example, the term may be used to describe a single blue LED, or it may be used to describe a red LED and a green LED in proximity emitting as a single source. Thus, the term "source" should not be construed as a limitation indicating either a single-element or a multi-element configuration unless clearly stated otherwise.

The term "color" as used herein with reference to light is meant to describe light having a characteristic average wavelength; it is not meant to limit the light to a single wavelength. Thus, light of a particular color (e.g., green, red, blue, yellow, etc.) includes a range of wavelengths that are grouped around a particular average wavelength.

Embodiments of the invention are described herein with reference to cross-sectional view illustrations that are schematic illustrations. As such, the actual thickness of layers can be different, and variations from the shapes of the illustrations as a result, for example, of manufacturing techniques and/or tolerances are expected. Thus, the regions illustrated in the figures are schematic in nature and their shapes are not intended to illustrate the precise shape of a region of a device and are not intended to limit the scope of the invention.

FIGS. 1*a* and 1*b* illustrate a luminaire 100 according to an embodiment of the present invention. FIG. 1*a* is a top plan view of the luminaire 100 with a portion of the casing not shown to expose the LEDs. FIG. 1*b* is an internal view of one half of the luminaire from cut plane A-A. A protective casing 102 has an inner surface 104 that defines a cavity 106. One or more LEDs 108 are disposed around the perimeter of the casing 102. In this particular embodiment, twelve LEDs 108 are distributed such that the LEDs 108 are spaced evenly around the perimeter. It is understood the different numbers of LEDs may be used in a variety of spacing configurations, including configurations where the LEDs are not evenly spaced around the perimeter. The LEDs 108 are angled to emit light toward the inner surface 104 of the casing 102 as shown in FIG. 1*b*. The inner surface 104 is coated with a diffuse reflective coating 110 which helps to randomize the light from the LEDs 108. Light is redirected away from the inner surface 104 and ultimately emitted out the exit end of the casing 102.

Although the reflective coating 110 in this embodiment comprises a diffuse reflective material, it is understood that, in other embodiments, the reflective coating may comprise a specular reflective material. Other embodiments comprise a reflective layer having a reflective characteristic that is partially diffuse and partially specular.

The protective casing 102 defines the cavity 106, providing the shape for the inner surface 104. During operation LEDs can generate significant amounts of heat, especially when high-power, high-output LEDs are used. To facilitate the transfer of heat away from the LEDs, a high thermal conductivity material, such as aluminum, for example, may be used to construct the casing 102. Additional heat sink elements may be included in thermal contact with the casing 102. Such elements may include fins, for example, or other structures designed to increase surface area from which heat can escape into the ambient.

The LEDs 108 are disposed around the perimeter of the casing 102 as shown. In this embodiment, the LEDs 108 are mounted on extensions 112 protruding a short distance out from the casing 102 over the cavity 106. Structures extending a farther distance out from the casing 102 may also be used as discussed in more detail herein. The extensions 112 provide a mount space for LEDs 108 that is close to the body of the casing 102. The proximity of the LEDs 108 to the casing 102 provides a short, efficient path from the source of heat to the casing 102 where it can be easily dissipated. This is in contrast to center-mount models where the thermal path from the light sources over the center of the cavity is longer, sometimes requiring the use of additional heat dissipation elements, such as heat tubes. Spacing the LEDs 108 around the casing 102 perimeter also improves thermal management by evenly distributing the heat sources around the casing.

Furthermore, mounting the LEDs 108 around the perimeter of the casing 102, as opposed to suspending the sources somewhere over the center of the cavity 106, reduces the amount of light that is absorbed or blocked by the LEDs 108 themselves or their mounting mechanisms, improving the overall efficiency of the luminaire.

The LEDs 108 are angled such that at least a portion of the emitted light is incident on the inner surface 104. In order to improve spatial and spectral mixing, a diffuse reflective coating 110 may be disposed on the inner surface 104. Several commercially available materials can achieve a wide-spectrum diffuse reflectivity above 95%. One acceptable material is titanium dioxide ($TiO_2$), although many other materials may also be used. Light from the LEDs 108 impinges on the inner surface 104 and is redirected back into the cavity 106 in a forward direction with a randomized Lambertian profile. Thus, the coated inner surface serves to both spatially randomize and spectrally mix the outgoing light.

Diffuse reflective coatings have the inherent capability to mix light from LEDs having different spectra (i.e., different colors). These coatings are particularly well-suited for multi-source designs where two different spectra are mixed to produce a desired output color point. For example, LEDs emitting blue light may be used in combination with LEDs emitting yellow (or blue-shifted yellow) light to yield a white light output. The diffuse reflective coating 110 may eliminate the need for additional spatial color-mixing schemes that can introduce lossy elements into the system; although, in some embodiments it may be desirable to use the diffuse reflective coating 110 in combination with other diffusive elements.

The luminaire 100 may comprise one or more emitters producing the same color of light or different colors of light. In one embodiment, a multicolor source is used to produce white light. Several colored light combinations will yield white light. For example, it is known in the art to combine light from a blue LED with wavelength-converted yellow light which combine to yield white light with correlated color temperature (CCT) in the range between 5000K to 7000K (often designated as "cool white"). Both blue and yellow light can be generated with a blue emitter by surrounding the emitter with phosphors that are optically responsive to the blue light. When excited, the phosphors emit yellow light which then combines with the blue light to make white. In this scheme, because the blue light is emitted in a narrow spectral range it is called saturated light. The yellow light is emitted in a much broader spectral range and, thus, is called unsaturated light.

Another example of generating white light with a multicolor source is combining the light from green and red LEDs. RGB schemes may also be used to generate various colors of light. In some applications, an amber emitter is added for an RGBA combination. The previous combinations are exemplary; it is understood that many different color combinations may be used in embodiments of the present invention. Several of these possible color combinations are discussed in detail in U.S. Pat. No. 7,213,940 to Van de Ven et al.

This particular luminaire 100 features 12 LEDs 108 which are evenly distributed around the perimeter of the casing 102; however, it is understood that other embodiments may have more or fewer sources.

FIGS. 2*a* and 2*b* illustrate a luminaire 200 according to an embodiment of the present invention. FIG. 2*a* is a top plan view with half of a faceplate not pictured to reveal the elements underneath. FIG. 2*b* is an internal view of one half of the luminaire from cut plane B-B. The luminaire 200 shares many common elements with the luminaire 100. For convenience, common elements will retain their reference numerals.

This particular luminaire 200 comprises four LEDs 108 which are mounted to mounting posts 202 that extend from the perimeter of the casing 102 out over the cavity. The mounting posts 202 may be used to change the angle at which light emitted from the LEDs 108 impinges the inner surface 104. The mounting posts 202 can extend varying distances out over the cavity. The mounting posts 202 may be a part of the casing 102 or may be separate parts which are affixed thereto, in which case they may be made of an optically transparent material. If the mounting posts 202 are attached as separate parts, they should be in good thermal contact with the casing 102 to provide an efficient thermal path away from the LEDs 108.

A faceplate 204 is attached over the exit end of the luminaire 200. In some embodiments, the faceplate 204 comprises a diffusive material. A diffusive faceplate functions in several ways. For example, it can prevent direct visibility of the LEDs 108 at viewing angles close to the horizontal plane and any remote phosphor plate underneath, if used, and can also provide additional mixing of the outgoing light to achieve a visually pleasing uniform source. However, a diffusive faceplate can introduce additional optical loss into the system. Thus, in embodiments where the light is sufficiently mixed by the diffusive reflective coating 110 on the casing inner surface 104 or by other elements, a diffusive faceplate may be unnecessary. In such embodiments, a transparent glass faceplate may be used. In still other embodiments, scattering particles may be included in the faceplate to help prevent the visibility of individual sources.

Figure 3A:
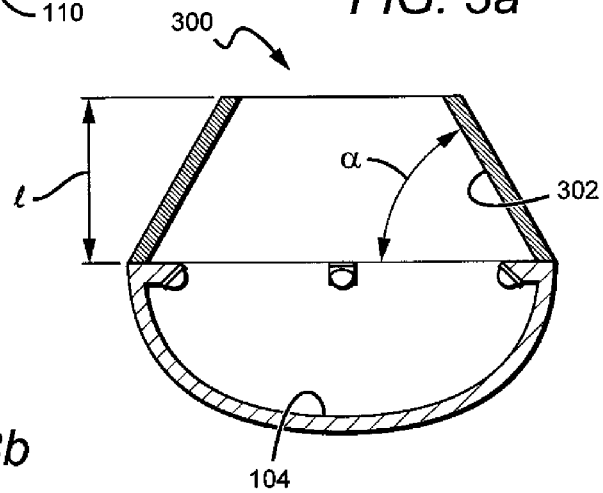
FIG. 3*a* is a cross-sectional internal view of a luminaire according to an embodiment of the present invention.

In some cases it may be desirable to achieve a narrower exit beam angle. FIG. 3*a* is a cross-sectional internal view of a luminaire 300 according to an embodiment of the present invention. In order to reduce the exit beam angle, this embodiment includes a specular reflective cone 302. The cone 302 collimates the outgoing light which has been redirected from the inner surface 104. The output beam angle can be controlled by adjusting the geometry of the cone 302 (e.g., the length of the extension l and the cone angle $\alpha$). The internal surface of the cone 302 can be highly reflective to reduce the loss associated with each bounce the light experiences along the exit path.

Figure 3B:
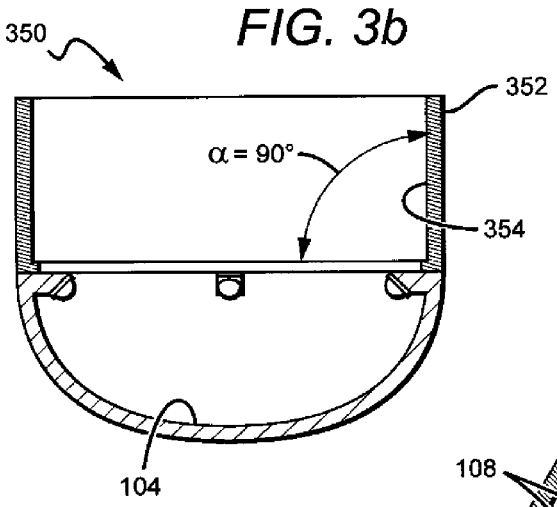
FIG. 3*b* is a cross-sectional internal view of a luminaire according to an embodiment of the present invention.

FIG. 3*b* is a cross-sectional internal view of a luminaire 350 according to another embodiment of the present invention. This embodiment includes a specular reflective cylinder 352 to collimate the light which has been redirected by the inner surface 104. Because the element is a cylinder, $\alpha$=90°, as shown. The internal surface of the cylinder 354 can be highly reflective to reduce the loss associated with each bounce the light experiences along the exit path.

Figure 4A:
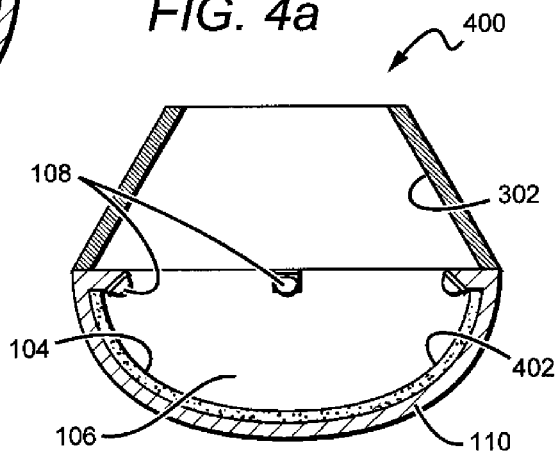
FIG. 4*a* is a cross-sectional internal view of a luminaire according to an embodiment of the present invention.

FIG. 4*a* is a cross-sectional internal view of a luminaire 400 according to an embodiment of the present invention. This embodiment features a remote wavelength conversion layer 402. Acceptable materials for the wavelength conversion layer 402 include phosphors, although other materials may also be used. The wavelength conversion layer is disposed on the inner surface 104, remote from the LEDs 108. Light from the LEDs 108 passes through the wavelength conversion layer 402 where a portion of the light is converted to a different wavelength, as described in detail herein. Converted and unconverted light is redirected by the inner surface 104 and mixed by the diffuse reflective coating 110. The mixed light then exits the cavity 106 and, in this embodiment, is collimated by the cone 302.

Although the remote wavelength conversion layer 402 is disposed on the inner surface 104, it is understood that in other embodiments, a remote conversion layer may be arranged in any location along the light path from its emission at the source to its exit point from the luminaire. For example, the wavelength conversion material can be disposed within the collimating cone 302 or in a plate over the exit end of the cone 302. The wavelength conversion material may be dispersed as a layer on a surface, or it may be dispersed volumetrically throughout a solid structure.

In some embodiments a single LED chip or package can be used, while in others multiple LED chips or packages can be used arranged in different types of arrays as a single source. By having the phosphor thermally isolated from LED chips and with good thermal dissipation, the LED chips can be driven by higher current levels without causing detrimental effects to the conversion efficiency of the phosphor and its long term reliability. This can allow for the flexibility to overdrive the LED chips to lower the number of LEDs needed to produce the desired luminous flux, which in turn can reduce the cost and complexity of the lamps. These LED packages can comprise LEDs encapsulated with a material that can withstand the elevated luminous flux or can comprise unencapsulated LEDs.

In some embodiments the light source 108 can comprise one or more blue emitting LEDs, and the wavelength conversion layer 402 can comprise one or more materials that absorb a portion of the blue light and emit one or more different wavelengths of light such that the luminaire 400 emits a white light combination from the blue LEDs and the wavelength conversion material 402. The conversion material 402 can absorb the blue LED light and emit different colors of light including but not limited to yellow and green. The light source 108 can comprise many different combinations LEDs and conversion materials emitting different colors of light so that the luminaire 400 emits light according to desired characteristics such as color temperature and color rendering.

As discussed above, in one embodiment light from a blue LED is combined with wavelength-converted yellow light to yield white light with a CCT in the range of 5000K to 7000K ("cool white"). In another embodiment, the wavelength conversion material comprises a mixture of yellow and red phosphor. By tuning the phosphor ratio and thickness, the combined emission of the blue, yellow, and red light can yield white light from warm white to neutral white (i.e., CCT ranging from 2600K to 5500K). Many other schemes may also be used to generate white light.

Conventional lamps incorporating both red and blue LEDs can be subject to color instability with different operating temperatures and dimming. This can be due to the different behaviors of red and blue LEDs at different temperatures and operating powers (current/voltage), as well as different operating characteristics over time. This effect can be mitigated somewhat through the implementation of an active control system that can add cost and complexity to the overall lamp. Different embodiments according to the present invention can address this issue by having a light source with the same type of emitters in combination with a remote wavelength conversion layer that can comprise multiple layers of phosphors that remain relatively cool. In some embodiments, the remote phosphor can absorb light from the emitters and can re-emit different colors of light, while still experiencing the efficiency and reliability of reduced operating temperature for the phosphors.

The separation of the wavelength conversion layer 402 from the LEDs 108 provides the added advantage of easier and more consistent color binning. This can be achieved in a number of ways. LEDs from various bins (e.g., blue LEDs from various bins) can be assembled together to achieve substantially uniform excitation sources that can be used in different lamps. These can then be combined with wavelength conversion elements having substantially the same conversion characteristics to provide luminaires emitting light within the desired bin. In addition, numerous conversion elements can be manufactured and pre-binned according to their different conversion characteristics. Different conversion elements can be combined with light sources emitting different characteristics to provide a luminaire emitting light within a target color bin.

Figure 4B:
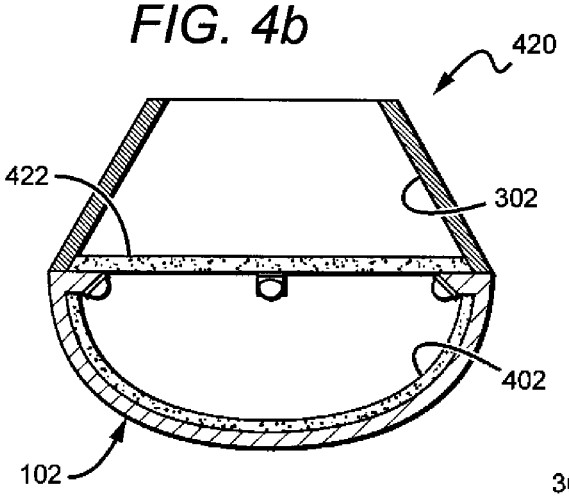
FIG. 4*b* is a cross-sectional internal view of a luminaire according to an embodiment of the present invention.

FIG. 4*b* is a cross-sectional internal view of a luminaire 420 according to an embodiment of the present invention. This embodiment is similar to the luminaire 400; however, the luminaire 420 further comprises a remote diffuser 422 in combination with the remote wavelength conversion layer 402. The remote diffuser 422 is disposed over the exit end of the casing 102. The remote diffuser 422 may be a component of the reflective cone 302, or it may be formed separately with the cone 302 being mounted over top of the diffuser 422.

Figure 4C:
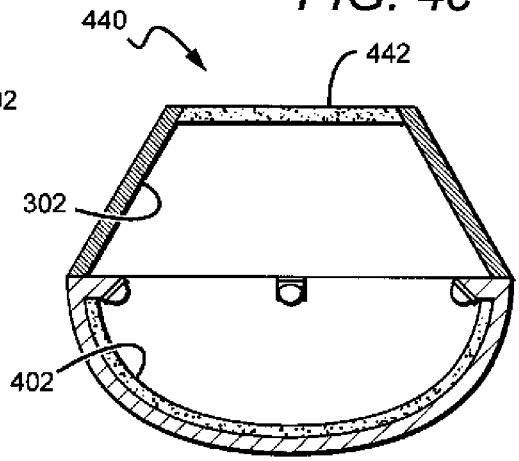
FIG. 4*c* is a cross-sectional internal view of a luminaire according to an embodiment of the present invention.

FIG. 4*c* is a cross-sectional internal view of a luminaire 440 according to an embodiment of the present invention. This embodiment is similar to the luminaire 400; however, the luminaire 440 further comprises a remote diffuser 442 in combination with the remote wavelength conversion layer 402. In this embodiment the diffuser 442 is disposed at the exit end of the reflective cone 302.

Figure 5A:
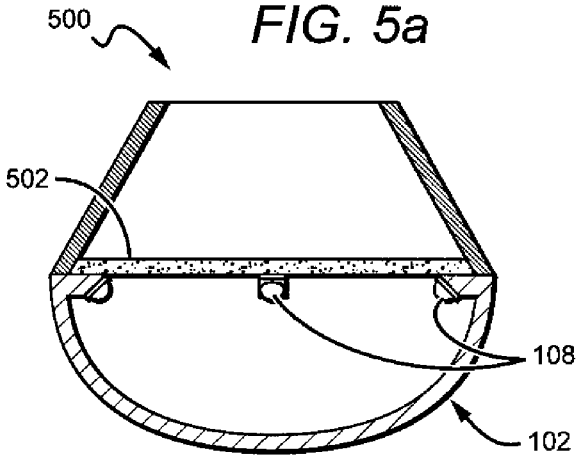
FIG. 5*a* is a cross-sectional internal view of a luminaire according to an embodiment of the present invention.

FIG. 5*a* is a cross-sectional internal view of another luminaire 500 according to an embodiment of the present invention. This particular embodiment comprises a remote wavelength conversion element 502. The wavelength conversion element 502 is disposed over the exit end of the casing 102 such that redirected light from the LEDs 108 passes through the wavelength conversion element 502 before it is emitted from the luminaire 500. The wavelength conversion element 502 can comprise a transparent (or translucent) faceplate with phosphor particles dispersed throughout. The wavelength conversion element 502 may comprise additional features such as an anti-reflective coating, for example. Other embodiments may include more than one remote wavelength conversion element arranged within or on the casing 102.

Figure 5B:
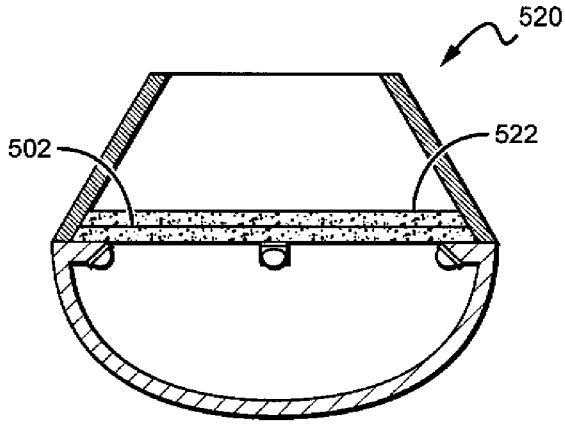
FIG. 5*b* is a cross-sectional internal view of a luminaire according to an embodiment of the present invention.

FIG. 5*b* is a cross-sectional internal view of a luminaire 520 according to an embodiment of the present invention. This embodiment is similar to the luminaire 500; however, the luminaire 520 further comprises a remote diffuser 522 in combination with the remote wavelength conversion layer 502. The remote diffuser 522 is disposed on the remote wavelength conversion layer 502. The remote diffuser 522 may be integral to the wavelength conversion layer 502, or it may be formed separately and mounted on the wavelength conversion layer 502.

Figure 5C:
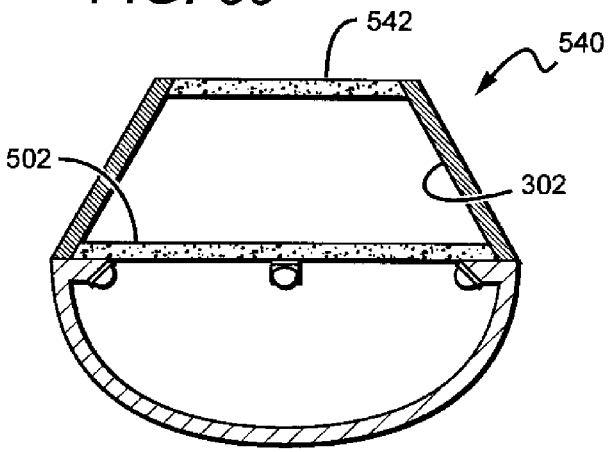
FIG. 5*c* is a cross-sectional internal view of a luminaire according to an embodiment of the present invention.

FIG. 5*c* is a cross-sectional internal view of a luminaire 540 according to an embodiment of the present invention. This embodiment is similar to the luminaire 500; however, the luminaire 540 further comprises a remote diffuser 542 in combination with the remote wavelength conversion layer 502. In this embodiment the diffuser 542 is disposed at the exit end of the reflective cone 302.

Although the remote diffuser is shown in various exemplary arrangements, it is understood that, in other embodiments, a remote diffuser may be arranged in any location along the light path from its emission at the source to its exit point from the luminaire. The diffusive material may be dispersed as a layer on a surface, or it may be dispersed volumetrically throughout a solid structure.

Figure 6:
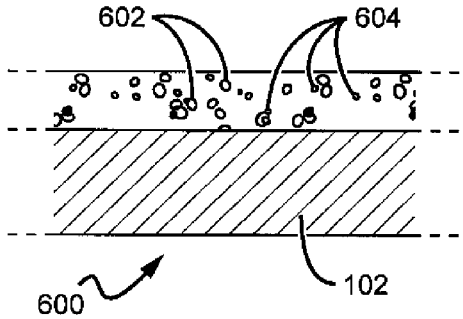
FIG. 6 is a cross-sectional view of a diffuse reflective coating according to an embodiment of the present invention.

In some embodiments, it may be desirable to combine wavelength conversion particles, such as phosphors, with light scattering particles to create a color-tunable diffuse reflective coating. FIG. 6 is a cross-sectional view of such a diffuse reflective coating 600. This embodiment comprises a mixture of both phosphor particles 602 and light scattering particles 604. The coating 600 is disposed on a backing substrate, such as the casing 102, for example. Typical phosphor particles are larger than the ideal scattering particle. For this reason, phosphors may not be an efficient means to scatter the light. Thus, it may be desirable to use the smaller scattering particles 604 to back-scatter the light. Scattering particles are commercially available in paste form and can achieve a diffuse reflectivity around 95%. Combining more efficient phosphor particles with smaller light scattering particles may yield a more efficient coating. The mixture of phosphor particles and light scattering particles provides color conversion and color mixing, yielding a Lambertian profile. Such a coating may eliminate the need for secondary color-mixing optics.

Figure 7:
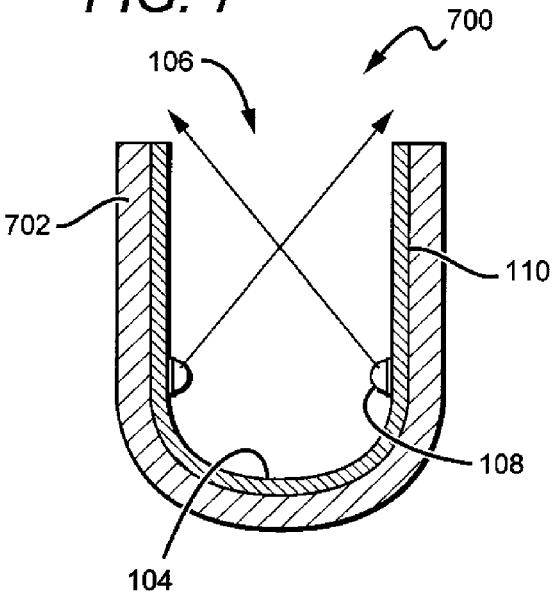
FIG. 7 is a cross-sectional view of a luminaire according to an embodiment of the present invention.

FIG. 7 is a cross-sectional view of a luminaire 700 according to an embodiment of the present invention. The luminaire 700 features a U-shaped casing 702. The LEDs 108 are arranged around an inner perimeter of the casing 702. The LEDs 108 may be angled to face or each other across the cavity 106, or they may be angled more in the direction of the diffuse reflective coating 110 on the inner surface 104 opposite the exit end. In this embodiment, light emitted from the LEDs 108 at a high angle escapes from the luminaire 700 (as shown by the arrows) without interacting with the diffuse reflective coating 110 which may comprise phosphors. Thus, a portion of the light leaves the luminaire 700 without being mixed or converted.

Figure 8:
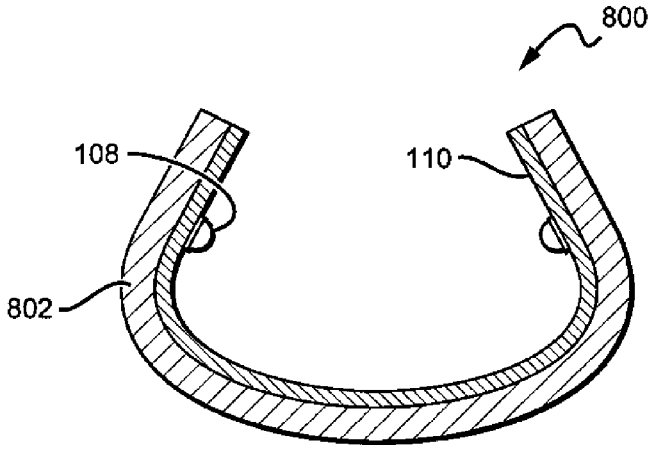
FIG. 8 is a cross-sectional view of a luminaire according to an embodiment of the present invention.

FIG. 8 is a cross-sectional view of a luminaire 800 according to an embodiment of the present invention. The casing 802 is also U-shaped but with the ends bent inward. Light from the LEDs 108 is redirected at the diffuse reflective coating 110. In this configuration, less light escapes the luminaire 800 without interacting with the diffuse reflective coating 110 when compared to the configuration of the luminaire 700.

The luminaires 700, 800 are shown as exemplary configurations according to embodiments of the present invention. It is understood that many different shapes can be used for the casing to give the luminaire a general shape.

Figure 9A:
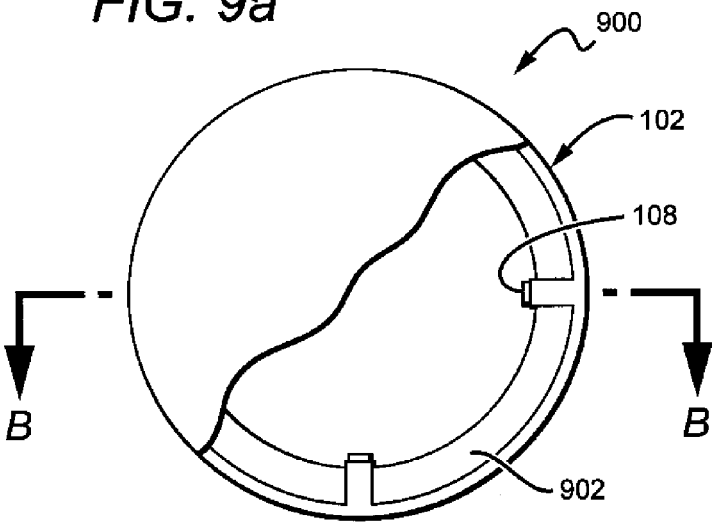
FIG. 9*a* is a top plan view of a luminaire according to an embodiment of the present invention with half of a faceplate not pictured to reveal the elements underneath.
Figure 9B:
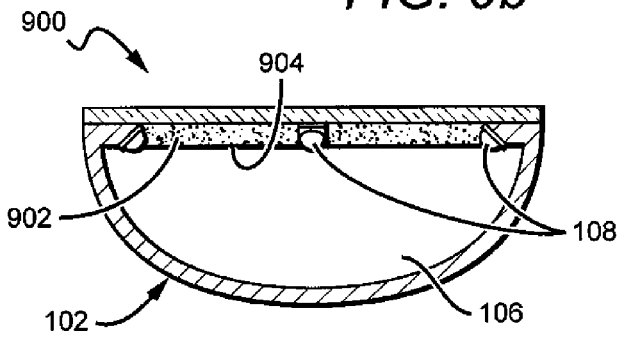
FIG. 9*b* is an internal view of one half of the luminaire of FIG. 9*a* from cut plane C-C.

FIGS. 9*a* and 9*b* illustrate a luminaire 900 according to an embodiment of the present invention. FIG. 9*a* is a top plan view with half of a faceplate not pictured to reveal the elements underneath. FIG. 9*b* is an internal view of one half of the luminaire from cut plane B-B. The embodiment shares several common elements with those shown in FIGS. 2*a* and 2*b*. These common elements are indicated with common reference numerals. This particular embodiment comprises a transparent ring structure 902 around the top perimeter of the casing 102. The LEDs 108 are embedded in ring 902 and emit light into the ring 902 which is diffused therein. The ring 902 may have a roughened inner surface 904 to improve light extraction from the ring 902 into the cavity 106. In other embodiments the ring 902 may be used as the primary mounting means for the LEDs, eliminating the need for mounting posts. In still other embodiments, it is understood that many different structures may be used to mount the LEDs out over the cavity.

Figure 10:
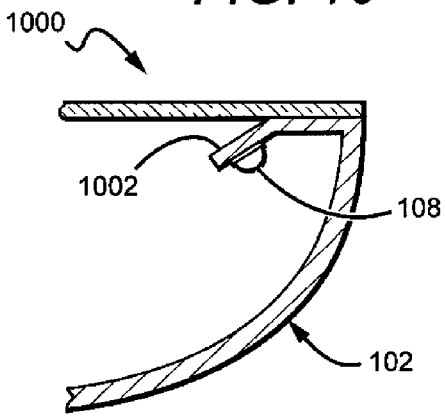
FIG. 10 is a cross-sectional view of a portion of a luminaire according to an embodiment of the present invention.

FIG. 10 is a cross-sectional view of a portion of a luminaire 1000 according to an embodiment of the present invention. In this embodiment, a mounting post 1002 extends into the cavity 106 from the casing 102. As shown, the LED 108 mounted to the post 1002 such that it is angled back away from the center of the cavity 106. It is understood that the LEDs 108 may be mounted at many different angles to achieve an output profile that is tailored to a particular application.

It is understood that embodiments presented herein are meant to be exemplary. Embodiments of the present invention can comprise any combination of compatible features shown in the various figures, and these embodiments should not be limited to those expressly illustrated and discussed.

Although the present invention has been described in detail with reference to certain preferred configurations thereof, other versions are possible. Therefore, the spirit and scope of the invention should not be limited to the versions described above.

I claim:

1. A luminaire device, comprising:

a casing comprising an exit end and an inner surface, wherein said inner surface includes a diffuse reflective material, wherein said casing defines a cavity; and at least one radiative source mounted around a perimeter of said casing, said at least one radiative source angled to emit radiation toward said inner surface.

2. The luminaire device of claim 1, said at least one radiative source comprising multiple radiative sources mounted around said perimeter of said casing.

3. The luminaire device of claim 2, said multiple radiative sources comprising sources constructed to emit multiple different spectra.

4. The luminaire device of claim 2, said multiple radiative sources comprising sources constructed to emit a single spectrum.

5. The luminaire device of claim 2, wherein said multiple radiative sources are mounted around said perimeter of said casing such that said radiative sources are evenly spaced.

6. The luminaire device of claim 1, further comprising a wavelength conversion material mixed into said reflective material layer.

7. The luminaire device of claim 1, further comprising at least one mounting beam that extends from an edge of said casing into said cavity, each of said at least one radiative sources mounted to a respective one of said at least one mounting beams.

8. The luminaire device of claim 1, further comprising a faceplate mounted over said exit end such that light emitted from the cavity passes through said faceplate.

9. The luminaire device of claim 8, said faceplate comprising a diffuser.

10. The luminaire device of claim 8, said faceplate comprising a wavelength conversion material.

11. The luminaire device of claim 8, said faceplate comprising light scattering particles.

12. The luminaire device of claim 1, further comprising a heat sink in thermal contact with said casing.

13. The luminaire device of claim 1, said inner surface comprising a wavelength conversion material.

14. The luminaire device of claim 1, further comprising a lens mounted over said exit end to shape the output beam profile.

15. The luminaire device of claim 1, further comprising a specular collimating cone mounted over said exit end.

16. The luminaire device of claim 1, said at least one radiative source comprising at least one light emitting diode (LED) constructed to emit light in the visible spectrum.

17. The luminaire device of claim 1, further comprising a remote wavelength conversion element.

18. The luminaire device of claim 1, further comprising a remote diffuser.

19. A luminaire device, comprising:

a casing comprising an exit end and an inner surface, wherein said inner surface includes a reflective material, wherein said casing defines a cavity; and a plurality of light emitters disposed around a perimeter of said casing at said exit end, each of said light emitters angled to emit light toward said inner surface;

wherein said emitters can emit different spectra.

20. The luminaire device of claim 19, wherein said plurality of emitters are mounted around said perimeter of said casing such that said plurality of emitters are evenly spaced.

21. The luminaire device of claim 19, wherein said reflective material is diffuse reflective.

22. The luminaire device of claim 19, wherein said reflective material is specular reflective.

23. The luminaire device of claim 19, wherein said reflective material is both diffuse reflective and specular reflective.

24. The luminaire device of claim 19, further comprising a wavelength conversion material mixed in with said reflective material.

25. The luminaire device of claim 19, further comprising a plurality of mounting beams that extend from an edge of said casing into said cavity, each of said emitters mounted to a respective one of said mounting beams.

26. The luminaire device of claim 19, further comprising a faceplate mounted over said exit end such that light emitted from the cavity passes through said faceplate.

27. The luminaire device of claim 26, said faceplate comprising a diffuser.

28. The luminaire device of claim 26, said faceplate comprising a wavelength conversion material.

29. The luminaire device of claim 26, said faceplate comprising light scattering particles.

30. The luminaire device of claim 19, further comprising a lens mounted over said exit end to shape the output beam profile.

31. The luminaire device of claim 19, further comprising a specular collimating cone mounted over said exit end.

32. The luminaire device of claim 19, said plurality of emitters comprising at least one light emitting diode (LED) constructed to emit light in the visible spectrum.

33. The luminaire device of claim 19, said plurality of emitters comprising LEDs of a first color and LEDs of a second color, said first and second color LEDs disposed around said perimeter of said casing in an alternating fashion.

34. The luminaire device of claim 19, further comprising a remote wavelength conversion element.

35. The luminaire device of claim 19, further comprising a remote diffuser.

36. The luminaire device of claim 19, further comprising a transparent ring structure disposed around the inner perimeter of said casing at the exit end, said light emitters disposed within said ring structure.

37. The luminaire device of claim 36, said ring structure comprising at least one roughened surface.

38. A luminaire device, comprising:

a casing comprising an exit end and an inner surface, wherein said inner surface includes a reflective material, wherein said casing defines a cavity;

a ring structure disposed around and within the perimeter of said casing; and a plurality of light emitting devices embedded within said ring structure, each of said light emitting devices arranged to emit light toward said inner surface.

39. The luminaire device of claim 38, wherein said ring structure is transparent.

40. The luminaire device of claim 38, said ring structure comprising at least one roughened surface.

41. The luminaire device of claim 38, said light emitting devices constructed to emit multiple different spectra.

42. The luminaire device of claim 38, said light emitting devices constructed to emit a single spectrum.

43. The luminaire device of claim 38, wherein said light emitting devices are mounted around said perimeter of said casing such that said light emitting devices are evenly spaced.

44. The luminaire device of claim 38, wherein said reflective material is diffuse reflective.

45. The luminaire device of claim 38, wherein said reflective material is specular reflective.

46. The luminaire device of claim 38, wherein said reflective material is both diffuse reflective and specular reflective.

47. The luminaire device of claim 38, further comprising a wavelength conversion material mixed in with said reflective material.

48. The luminaire device of claim 38, further comprising a plurality of mounting beams that extend from an edge of said casing into said cavity, each of said light emitting devices mounted to a respective one of said mounting beams.

49. The luminaire device of claim 38, further comprising a faceplate mounted over said exit end such that light emitted from the cavity passes through said faceplate.

50. The luminaire device of claim 49, said faceplate comprising a diffuser.

51. The luminaire device of claim 49, said faceplate comprising a wavelength conversion material.

52. The luminaire device of claim 49, said faceplate comprising light scattering particles.

53. The luminaire device of claim 38, further comprising a lens mounted over said exit end to shape the output beam profile.

54. The luminaire device of claim 38, further comprising a specular collimating cone mounted over said exit end.

55. The luminaire device of claim 38, said light emitting devices comprising at least one light emitting diode (LED) constructed to emit light in the visible spectrum.

56. The luminaire device of claim 38, said light emitting devices comprising LEDs of a first color and LEDs of a second color, said first and second color LEDs disposed around said perimeter of said casing in an alternating fashion.

57. The luminaire device of claim 38, further comprising a remote wavelength conversion element.

58. The luminaire device of claim 38, further comprising a remote diffuser.

59. The luminaire device of claim 38, further comprising a heat sink in thermal contact with said casing.

* * * * *